United States Patent [19]

Furuichi et al.

[11] Patent Number: 4,830,293

[45] Date of Patent: May 16, 1989

[54] HOMOGENIZING APPARATUS

[75] Inventors: Akira Furuichi; Yasutoshi Manii, both of Nishinomiya, Japan

[73] Assignee: Tokushu Kika Kogyo Kabushiki Kaisha, Osaka, Japan

[21] Appl. No.: 149,725

[22] Filed: Jan. 29, 1988

[30] Foreign Application Priority Data

Jan. 29, 1987 [JP] Japan ..... 62-17244

[51] Int. Cl.[4] ..... B02C 7/12

[52] U.S. Cl. ..... 241/163; 241/261.3; 241/297

[58] Field of Search ..... 241/285 R, 261.2, 261.3, 241/2, 161, 162, 163, 297

[56] References Cited

U.S. PATENT DOCUMENTS

| | | | |
|---|---|---|---|
| 1,074,299 | 5/1912 | Strack . | |
| 2,122,400 | 1/1936 | Anderson . | |
| 2,129,789 | 4/1936 | Seaborne . | |
| 2,580,579 | 9/1946 | Neenan . | |
| 2,661,667 | 12/1953 | Knoll | 241/163 |
| 4,253,613 | 2/1978 | Reinhall . | |
| 4,637,555 | 8/1984 | Furuichi et al. . | |

FOREIGN PATENT DOCUMENTS

| | | | |
|---|---|---|---|
| 527395 | 7/1956 | Canada | 241/163 |
| 1021460 | 6/1983 | U.S.S.R. | 241/163 |
| 418978 | 11/1934 | United Kingdom | 241/163 |

*Primary Examiner*—Mark Rosenbaum
*Attorney, Agent, or Firm*—Michael N. Meller

[57] ABSTRACT

A homogenizing apparatus has a number of grinding units made up of rotatable grinding members mounted in sequence on a drive shaft and corresponding fixed grinding members connected in sequence and supported only by the support frame which rotatably supports the drive shaft. The grinding surface of each rotatable grinding member opposes the grinding surface of a corresponding fixed grinding member, thereby forming a number of grinding zones. The raw material to be ground passes through all of the grinding zones in sequence. Complex pairs of grinding members can be added or removed to achieve the desired degree of grinding.

1 Claim, 4 Drawing Sheets

HOMOGENIZING APPARATUS

FIELD OF THE INVENTION

This invention relates to an apparatus for continuously pulverizing solid powder of cosmetics, medicines, foods, chemical products, or the like for homogenization.

BACKGROUND OF THE INVENTION

It is generally known that an object material is passed through a grinding zone comprising a pair of grinding members arranged in opposition to each other to form a grinding unit, thereby pulverizing the material for homogenization. This grinding unit is arranged in a processing container such that one grinding member thereof is mounted fixedly on and rotated by a driving shaft rotatable in the container, and the other grinding member thereof is fixedly mounted also within the container, the grinding members having grinding surfaces which are in frictional engagement with any raw material therebetween.

In general, one grinding unit consisting of a pair of grinding members as mentioned above is provided in a processing container.

In the above-mentioned conventional type of homogenizer in which one grinding unit is provided in a container of predetermined dimensions, due to the limited dimensions of a processing container it is difficult to increase the number of grinding units for the purpose of improving the homogenization performance of the apparatus. In other words, it is difficult to adapt such a conventional homogenizer to a multi-stage homogenizing operation.

BRIEF SUMMARY OF THE INVENTION

An object of the present invention is to eliminate the disadvantages of a conventional homogenizer of this kind and, more specifically to provide a homogenizer in which the component members of a plurality of grinding units can be arranged to form a processing container, thereby eliminating the need for a separate container, whereby a multi-stage homogenizer can be constructed easily and advantageously therefrom. In accordance with the invention, the number of grinding units used to make up such a multi-stage homogenizer may be easily increased or decreased depending on the kind of material to be processed. Thus, the axial dimension of the container can be varied automatically in accordance with the number of grinding units used. The homogenizer of the present invention is characterized in that it comprises a suitable number of grinding units, each of which consists of a flange-like movable member having an annular grinding surface formed on one side thereof and a cylindrical fixed member having formed on one side thereof an annular grinding surface which is arranged to oppose the annular grinding surface of the movable member. The fixed and movable members are combined to form a grinding zone of the unit. On the other side of the fixed member, a cylindrical portion is provided which is larger in diameter than the annular grinding surface and which projects from the fixed member. The movable members are mounted on a portion of a drive shaft which projects beyond a fixed machine frame. The projecting portion is inserted sequentially through the movable members of the respective grinding units. The movable members are secured thereon such that respective spaces are formed between the grinding zones of the respective units. The fixed members of the respective units are connected to one another sequentially at their cylindrical portions. An end member having a raw material feed port is connected to one end grinding unit. An end member having a discharge port is connected to the other end grinding unit. The two end members and a suitable number of the cylindrical fixed members interposed therebetween combine to form a cylindrical container which houses therein the grinding zones of the respective units and the projecting portion of the drive shaft and which is fastened securely to the fixed machine frame. A raw material fed through the feed port by pressure passes through the grinding zones of the respective grinding units and exits after processing by way of the discharge port.

In a homogenizer according to the present invention, a suitable number of grinding units, each of which has a grinding zone formed by a movable member and a fixed member, are mounted on a driving shaft projecting from a fixed machine frame, by slidably fitting the movable members of the grinding units sequentially onto the driving shaft and securing them thereon.

The fixed members of the respective units and the end members connected to the first and the last grinding units in the apparatus combine to form a container, which container is fastened securely to the fixed machine frame, so that there is provided a multi-stage homogenizer having a desired number of grinding zones formed in the container and a raw material fed into the container from a feed port by pressure is moved to pass sequentially through the grinding zones of the respective grinding units now in a multi-stage arrangement, this raw material being homogenized more finely each time it passes through a grinding zone.

Therefore, according to the present invention, the fineness of the pulverization for the purpose of homogenization can be adjusted by increasing or decreasing the number of movable members mounted on the driving shaft projecting from the fixed machine frame, while the size of the container formed by the fixed members is automatically changed in accordance with the increased or decreased number of movable members. This arrangement prevents the container from becoming too large or small for the number of grinding units installed therein.

BRIEF DESCRIPTION OF THE DRAWINGS

The preferred embodiment of the present invention will be described in detail with reference to the drawings, wherein.

DETAILED DESCRIPTION OF THE PREFERRED EMBODIMENT

Figure 1:
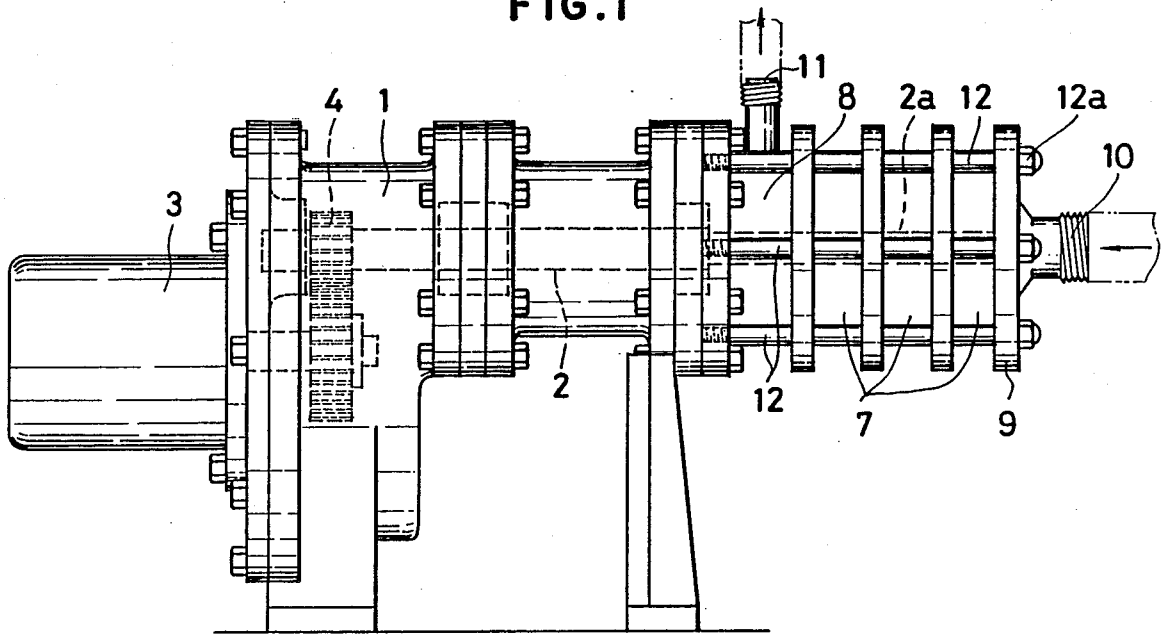
FIG. 1 is a side elevation of the homogenizing apparatus according to the present invention.

In the drawings, reference numeral 1 denotes a fixed machine frame which supports a driving shaft 2. This driving shaft 2 is adapted to be rotated by a motor 3 via a transmission of, for example, a gear mechanism 4, and one end portion 2*a* of the driving shaft 2 projects a predetermined length beyond the machine frame 1.

Figure 4:
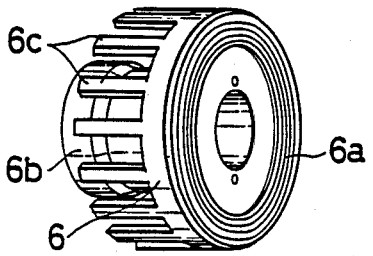
FIG. 4 is a perspective view of a movable member.
Figure 5:
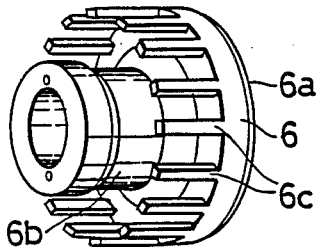
FIG. 5 is a perspective view, which is taken from the opposite side with respect to FIG. 4, of the movable member.

Reference numeral 5 denotes a grinding unit consisting of a movable member 6 and a fixed member 7. As shown in FIGS. 4 and 5, the movable member 6 comprises a flange-like member having an annular, uneven rough grinding surface 6*a* on one side thereof. In the illustrated embodiment, a tubular portion 6*b* is formed integrally with the movable member 6 on the side thereof opposite to its grinding surface 6*a*. The tubular portion 6*b* receives the projecting portion 2*a* of the driving shaft 2 for fastening the movable member securely to said shaft.

Figure 6:
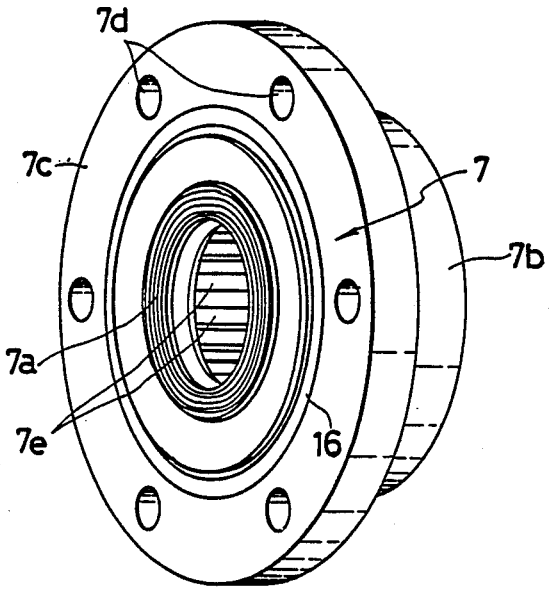
FIG. 6 is a perspective view of a fixed member.
Figure 7:
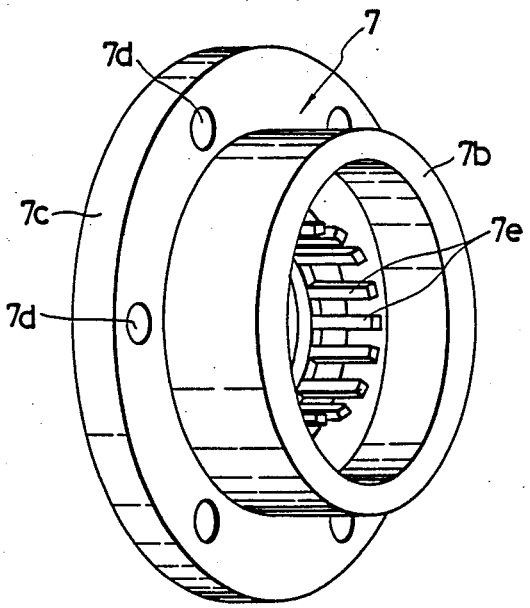
FIG. 7 is a perspective view, which is taken from the opposite side with respect to FIG. 6, of the fixed member.

As shown in FIGS. 6 and 7, the fixed member 7 comprises a flange-like member having on one side thereof an annular grinding surface 7*a* which is arranged to oppose the annular grinding surface 6*a* of the movable member 6 and combines therewith to form a grinding zone 5*a*. A cylindrical portion 7*b*, the diameter of which is larger than that of the annular grinding surface 7*a*, is formed on the other side of the flange-like member. In the illustrated embodiment, the fixed member 7 is provided with a flange 7*c* having connecting holes 7*d* for use in connecting a suitable number of fixed members 7 to one another in series as will be described later.

Reference numeral 8 denotes one end member, which is formed to be a cylindrical body having a flange 8*a* at one end thereof, a discharge port 11 being formed in the cylindrical portion of end member 8.

Reference numeral 9 denotes the other end member, which is formed like a disc in which an axial raw material feed port 10 is provided. An annular grinding surface 7*a*′ is formed on the inner side of the end member 9.

Figure 3:
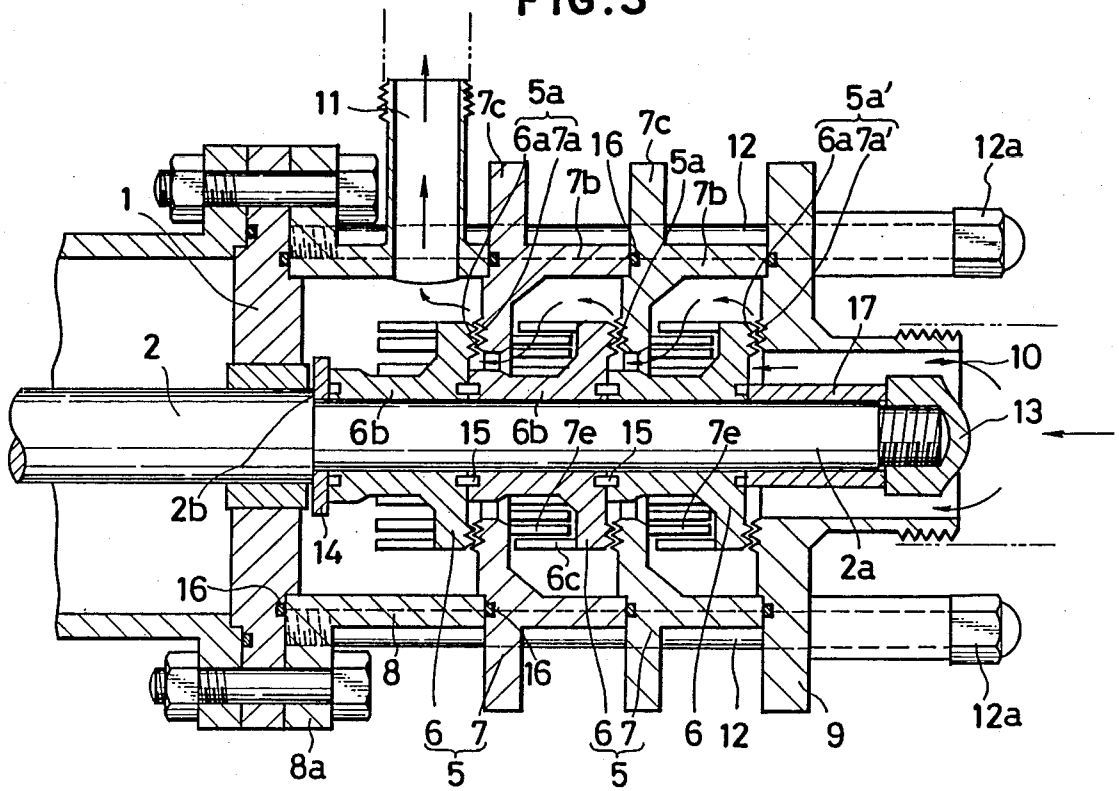
FIG. 3 is an enlarged, sectioned side elevation of a principal portion of the homogenizing apparatus with the number of grinding zones reduced.

In the illustrated embodiment, there are three grinding units 5, each consisting of a movable member 6 and a fixed member 7, the movable members being mounted on the projecting portion 2*a* of the driving shaft 2 projecting beyond the fixed machine frame 1 as shown in FIG. 3. However, in accordance with the invention fewer than three units can be incorporated in the homogenizer.

Figure 2:
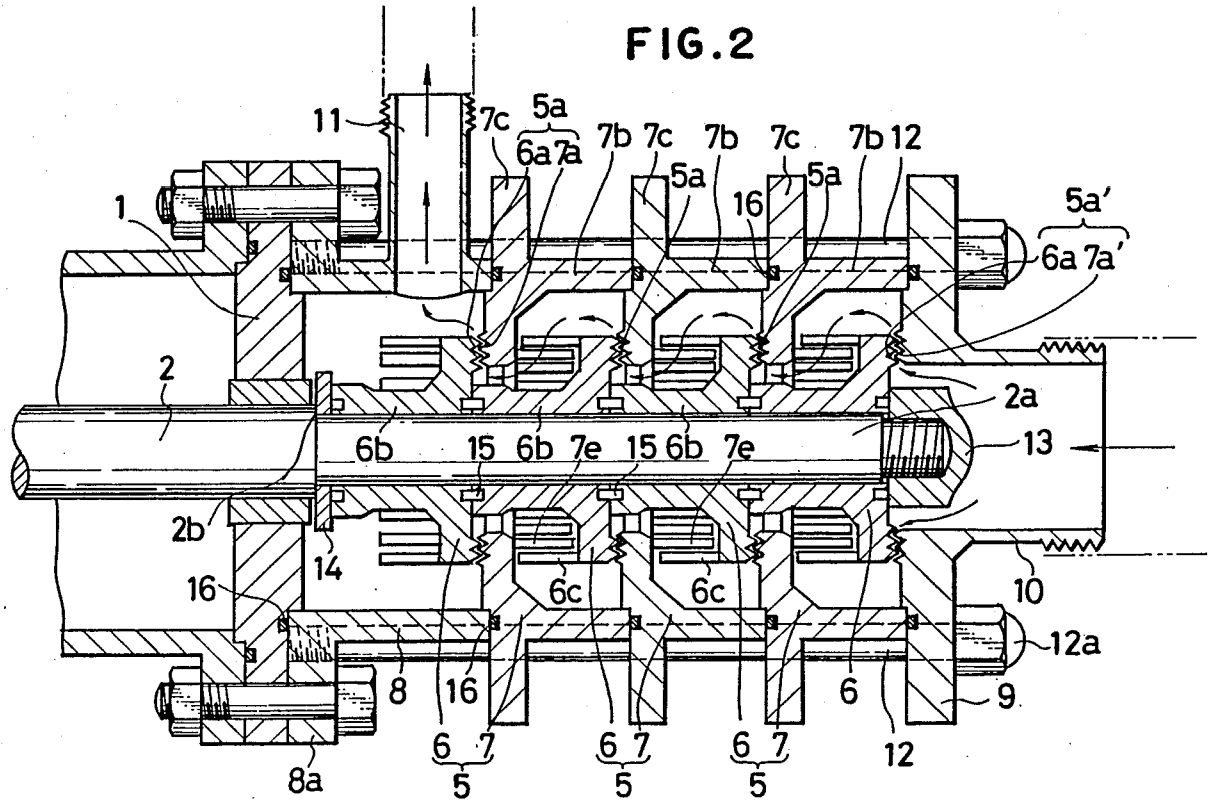
FIG. 2 is an enlarged, sectioned side elevation of a principal portion of the homogenizing apparatus.

More than three grinding units may be incorporated depending on the length of the projecting portion 2*a* of the driving shaft 2. The mounting of the grinding units 5 on the projecting portion 2*a* of the driving shaft 2 is carried out as follows. As shown in FIG. 2, first, the cylindrical end member 8 is fixed at its flange 8*a* to the outer end surface of the fixed machine frame 1 and a suitable number of connecting rods 12 are screwed at their base end portions to be fixed to the flange 8*a* of the end member 8 so as to project in the forward direction. Next, the tubular portion 6*b* of the movable member 6 of the first grinding unit 5 is then slidably fitted onto the projecting shaft 2*a*, and the connecting rods 12 are inserted into the connecting holes 7*d* provided in the flange 7*c* of the fixed member 7 of the same grinding unit 5. As a result the fixed member 7 is connected to the front portion of the end member 8 and the annular grinding surface 7*a* of the fixed member 7 of the first grinding unit is positioned to face the annular grinding surface 6*a* of the corresponding movable member 6, thereby forming a grinding zone 5*a* therebetween.

The movable members 6 and fixed members 7 of the second and third grinding units 5 are then mounted in series in the aforementioned manner on the projecting portion 2*a* of driving shaft 2 and on the connecting rods 12 respectively to form the second and third grinding zones 5*a*. Finally, the movable members 6 of the respective grinding units 5 are tightened together by a nut 13 threadingly engaged with the free end of the projecting portion 2*a*, so as to fasten the movable members 6 to the driving shaft 2, and the end member 9 is then mounted on the connecting rods 12 by having the rods inserted therethrough so as to securely abut the fixed member 7 of the final grinding unit. The nuts 12*a* are then tightened to secure the two end members 8,9 and the fixed members 7 interposed therebetween in series so that there is formed by this interconnection a cylindrical container enclosing the three grinding zones 5*a* and the projecting portion 2*a* of the shaft 2 therein. In this container, the grinding zones 5*a* of the grinding units are suitably spaced from one another by the tubular portions 6*b* of the movable members 6 and the cylindrical portions 7*b* of the fixed members 7 of the grinding units, while spaces are also formed on both sides of each grinding zone 5*a*.

In the illustrated embodiment, a fourth grinding zone 5*a*′ is provided additionally after the third grinding zone, forming a space therebetween by utilizing the end member 9. This fourth grinding zone 5*a*′ is formed by firmly fitting a movable member 6, the shape of which is identical with that of the movable members 6 mentioned above, around the projecting portion 2*a* of the driving shaft 2 which is immediately beyond the third grinding unit 5, in such a manner that an annular grinding surface 7*a*′ formed on the inner side of the end member 9 faces an annular grinding surface 6*a* which is formed on the fourth movable member 6. The fourth movable member is adapted to be turned such that its annular grinding surface and grinding surface 7*a*′ frictionally engage any raw material therebetween.

A raw material to be processed is sent under pressure through the feed port 10, passes in sequence through the above-described four grinding zones (5*a*′, 5*a*) and exists through the discharge port. The raw material is pulverized by the frictional movements of the grinding surfaces of the movable members, which are rotated by the driving shaft 2, with respect to the grinding surfaces of the fixed members in the grinding zones.

In this embodiment, the direction in which the raw material flows may be reversed by making port 11 the feed port and making port 10 the discharge port.

The clearance between the annular grinding surfaces 6*a*, 7*a* which forms each grinding zone 5*a* can be adjusted by changing the thickness of a washer 14 inserted between the movable member 6 of the first grinding unit and a stepped portion 2*b* formed on the driving shaft 2. The movable members 6 of the grinding units are connected sequentially by knock pins 15. The fixed machine frame 1, end members 8,9 and fixed members 7 are connected in an airtight manner by inserting packings 16 between the joint portions thereof.

If it becomes necessary to decrease the fineness of the pulverization performed by a homogenizing apparatus (that is, increase the particle size) in which three grinding units 5 are incorporated as mentioned above, the third grinding unit 5 is removed, and the end member 9 is moved axially inwardly, thereby reducing the number of grinding zones from four to three as shown in FIG. 3. In the alternative, the second grinding unit 5 can also be removed, thereby reducing the number of grinding zones from three to two, whereby the degree of coarseness is further increased. In such a case, a sleeve 17 of a predetermined length is fitted around the portion of the projecting portion 2*a* of shaft 2 which is beyond the movable member 6 in the end position, and it is secured by a tightened nut 13. In a homogenizing apparatus having a reduced number of grinding zones 5*a*, the number of grinding units 5 can be increased as occasion demands. When the grinding zones are thus increased and decreased, the number of fixed members 7 in use increases and decreases accordingly, so that the axial dimension of the container formed by the end members and fixed members varies automatically in accordance with the number of grinding zones 5*a*. Further, the grinding zones 5*a* may have the annular grinding surfaces 6*a*, 7*a* whose surface serrations are closer and finer as they are located closer to the discharge port side so that the grinding fineness may be increased. It is also possible that there may be interposed space of predetermined thickness between the adjacent movable members 6, 6 so that a space between the annular grinding surfaces 6*a*, 7*a* may be freely adjusted.

This embodiment is so formed that in addition to the grinding operations, the annular grinding surfaces 6*a*, 7*a* of the movable and fixed members 6, 7 perform the raw material-shearing and agitating operations. A cylindrical portion is provided on the surface of both the movable member 6 and the fixed member 7 in each grinding unit on the side opposite to the side carrying the grinding surface, and a plurality of axially extending slits are provided in the circumferential wall of each of the cylindrical portions of members 6, 7 to thereby form a plurality of cylindrically arranged comb-like projections 6*c*, 7*e*. These cylindrical portions of the movable and fixed members 6, 7 have different diameters so that projections 6*c*, 7*e* can be readily overlapped one over another. Upon assembly, the projections 7*e* of the fixed member 7 in the first grinding unit are encircled by the projections 6*c* of the movable member 6 in the second grinding unit and the projections 7*e* of the fixed member 7 in the second grinding unit are encircled by the projections 6*c* of the movable member 6 in the third grinding unit. The material-shearing and agitating operations are carried out by rotating the movable members 6, whereby the projections 6*c* rotate about the axis of the shaft 2.

The present invention enables a plurality of grinding zones to be easily formed in a multistepped manner by mounting a plurality of grinding units on a driving shaft in such a manner that the grinding units can be freely mounted or detached in the axial direction of the driving shaft. In each grinding unit the grinding surface of a movable member is rotated to frictionally engage any raw material sandwiched between the grinding surface of the movable member and an opposing grinding surface on a fixed member, these opposing grinding surfaces forming a grinding zone. Since a suitable number of fixed members, which are cylindrically formed, are arranged in contact with each other between two end members and are coupled in series, the multistep grinding zones as well as an enclosing container are formed at the same time. Moreover, the number of fixed numbers in use can be increased or decreased in accordance with an increase or decrease in the number of required grinding zones, so that the axial dimension of the container can be varied automatically. Accordingly, the required number of grinding zones can be selectively provided, and a raw material can be processed in a container having a reasonable axial dimension, the desired coarseness of the processed material being attained during the selected number of grinding steps. Therefore, the disadvantages of a conventional homogenizing apparatus of this kind, in which the formation of multistep grinding zones and the selection of the number of grinding units to be used are difficult since a grinding unit in such an apparatus is installed in a prefabricated container or vessel, can be eliminated. Thus, according to the present invention, a conveniently usable homogenizing apparatus can be obtained.

What is claimed is:

1. A homogenizing apparatus comprising:

(a) a plurality of grinding units, each of which consists of a flange-like movable member having a first annular grinding surface formed on one side thereof and a fixed member comprising a first portion having formed on one side thereof a second annular grinding surface which is arranged to oppose the first annular grinding surface of the movable member with clearance therebetween, thereby forming a grinding zone of the unit, said fixed member further having on the other side thereof a second portion which is cylindrical and larger in diameter than the second annular grinding surface and is integrally formed with the first portion so as to project axially therefrom, the first portion of the fixed members of the respective grinding units being connected to one another sequentially by the second portions;

(b) a projecting portion of a drive shaft projecting from a fixed machine frame, said movable members of the respective grinding units being detachably mounted in sequence on said projecting portion in a manner whereby respective spaces are formed between the movable members and the corresponding fixed members, said respective spaces each forming a path for the raw material to travel from one grinding zone to the next grinding zone;

(c) a first end member having a raw material feed port and connected to support the fixed member of a first one of said plurality of grinding units; and (d) a second end member having a discharge port and connected to the fixed member of the last one of said plurality of grinding units, said first and second end members and said fixed members interposed therebetween combining to form an external housing for said apparatus, said external housing having cylindrical portions formed by said second portions of said fixed members, whereby a raw material fed from the feed port by pressure goes through the grinding zones of the respective grinding units so as to be discharged from the discharge port.

* * * * *